US005632259A

United States Patent [19]

Konda et al.

[11] Patent Number: 5,632,259

[45] Date of Patent: May 27, 1997

[54] IGNITION APPARATUS FOR AN INTERNAL COMBUSTION ENGINE

[75] Inventors: Eiichiro Konda, Hitachinaka; Noboru Sugiura, Mito; Kazutoshi Kobayashi, Hitachinaka; Kenichi Katagishi, Hitachinaka; Yoichi Anzo, Hitachinaka; Hidetoshi Oichi, Hitachinaka; Hiroshi Watanabe, Takahagi, all of Japan

[73] Assignees: Hitachi, Ltd.; Hitachi Car Engineering Co., Ltd., both of Japan

[21] Appl. No.: 639,105

[22] Filed: Apr. 22, 1996

[30] Foreign Application Priority Data

Apr. 21, 1995 [JP] Japan ..... 7-096527

[51] Int. Cl.[6] ..... F02P 11/00

[52] U.S. Cl. ..... 123/634

[58] Field of Search ..... 123/634, 169 R, 123/169 PA, 635, 406; 336/105, 107, 108, 83, 110

[56] References Cited

U.S. PATENT DOCUMENTS

| | | | |
|---|---|---|---|
| 5,101,803 | 4/1992 | Nakamura et al. | 123/634 |
| 5,146,906 | 9/1992 | Agatsuma | 123/634 |
| 5,241,941 | 9/1993 | Hancock et al. | 123/634 |
| 5,333,592 | 8/1994 | Benedikt et al. | 123/634 |
| 5,357,233 | 10/1994 | Wada | 336/107 |
| 5,377,652 | 1/1995 | Noble et al. | 123/634 |
| 5,406,921 | 4/1995 | Noble et al. | 123/406 |
| 5,411,006 | 5/1995 | Noble et al. | 123/634 |
| 5,419,300 | 5/1995 | Maruyama et al. | 123/634 |
| 5,497,756 | 3/1996 | Matthieson et al. | 123/634 |

FOREIGN PATENT DOCUMENTS

| | | | |
|---|---|---|---|
| 2-92913 | 7/1990 | Japan | 123/634 |

*Primary Examiner*—Raymond A. Nelli

*Attorney, Agent, or Firm*—Evenson, McKeown, Edwards & Lenahan, P.C.

[57] ABSTRACT

A cylindrical type ignition apparatus housed in a spark plug hole of a cylinder of an internal combustion engine is disclosed. A center core, a primary coil, a secondary core and a side core are provided, and a closed magnetic path is formed by connecting magnetically the center core and the side core by a core on a high voltage side and a core on a low voltage side, or a semi-closed magnetic path is formed by connecting magnetically the center core and the side core by a core on a low voltage side.

15 Claims, 11 Drawing Sheets

IGNITION APPARATUS FOR AN INTERNAL COMBUSTION ENGINE

BACKGROUND OF THE INVENTION

The present invention relates to an ignition apparatus for an internal combustion engine, and more particularly to a cylindrical type ignition apparatus housed in a spark plug hole of an engine cylinder.

An example of the conventional ignition apparatus for an internal combustion engine is disclosed in Japanese Utility Application Laid-Open No. 2-92913, in which iron cores which form a closed magnetic path is housed inside a cylindrical plastic case, primary and secondary coils are fitted outside the iron core and their periphery is hardened with insulating resin, and an outer iron core is incorporated along a wall of the cylindrical plastic case. Because a lot of leakage magnetic flux occurs during energization of the primary coil in such a prior art, it is impossible effectively to utilize the magnetic flux generated by the primary coil. To obtain the desirable power, it is required to enlarge the cross-sectional area or increase the number of turns of the primary coil. Therefore, the ignition apparatus becomes large as an inevitable consequence.

Accordingly, the conventional ignition apparatus is not suitable to a cylindrical type ignition apparatus housed in a plug hole of an engine cylinder head and connected directly to a spark plug.

SUMMARY OF THE INVENTION

An object of the present invention is to provide a small cylindrical type ignition apparatus for an internal combustion engine, housed in a plug hole of an engine cylinder head and connected directly to a spark plug, in which the leakage magnetic flux can be suppressed and it is possible to generate a higher power.

In a cylindrical type ignition apparatus according to the present invention, a center core, a primary coil, a secondary core and a side core are provided, and a closed magnetic path is formed by connecting magnetically the center core and the side core by a core on a high voltage side and a core on a low voltage side, or a semi-closed magnetic path is formed by connecting magnetically the center core and the side core by a core on a low voltage side.

The center core is made by stacking or laminating the rolled silicone steel plates. The center core can be polygonal and formed by combining blocks, and each of the blocks is formed by stacking a plurality of rolled silicone steel plates with different width. Further, the center core can be formed by stacking silicone steel plates of which width are increased or decreased gradually. In this case, the shape of the center core is almost cylindrical. Thereby, it is possible to increase the cross-sectional area of a center core, and make the center core effective for a high power.

Further, by inserting a magnet for biasing reversely against the magnetic flux generated by the primary coil into an air-gap portion formed between the center core and the side core, it becomes possible to provide a small, light and powerful cylindrical type ignition apparatus.

PREFERRED EMBODIMENTS OF THE INVENTION

Figure 1:
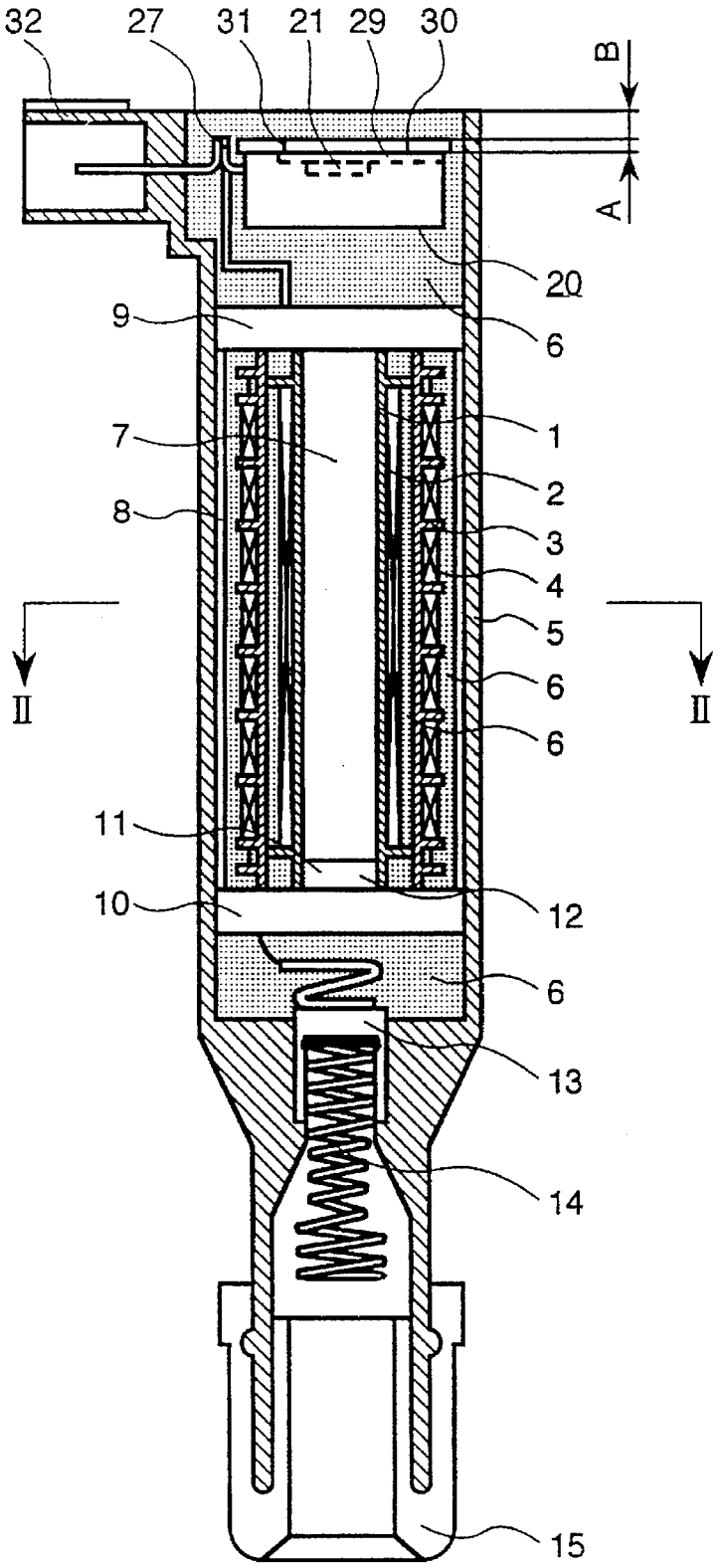
FIG. 1 is a sectional view showing an ignition apparatus in which cores that form a closed magnetic path are used.

An embodiment of the present invention will be explained hereinafter with reference to FIGS. 1 and 2. Like reference characters denote like parts in these views.

Figure 2:
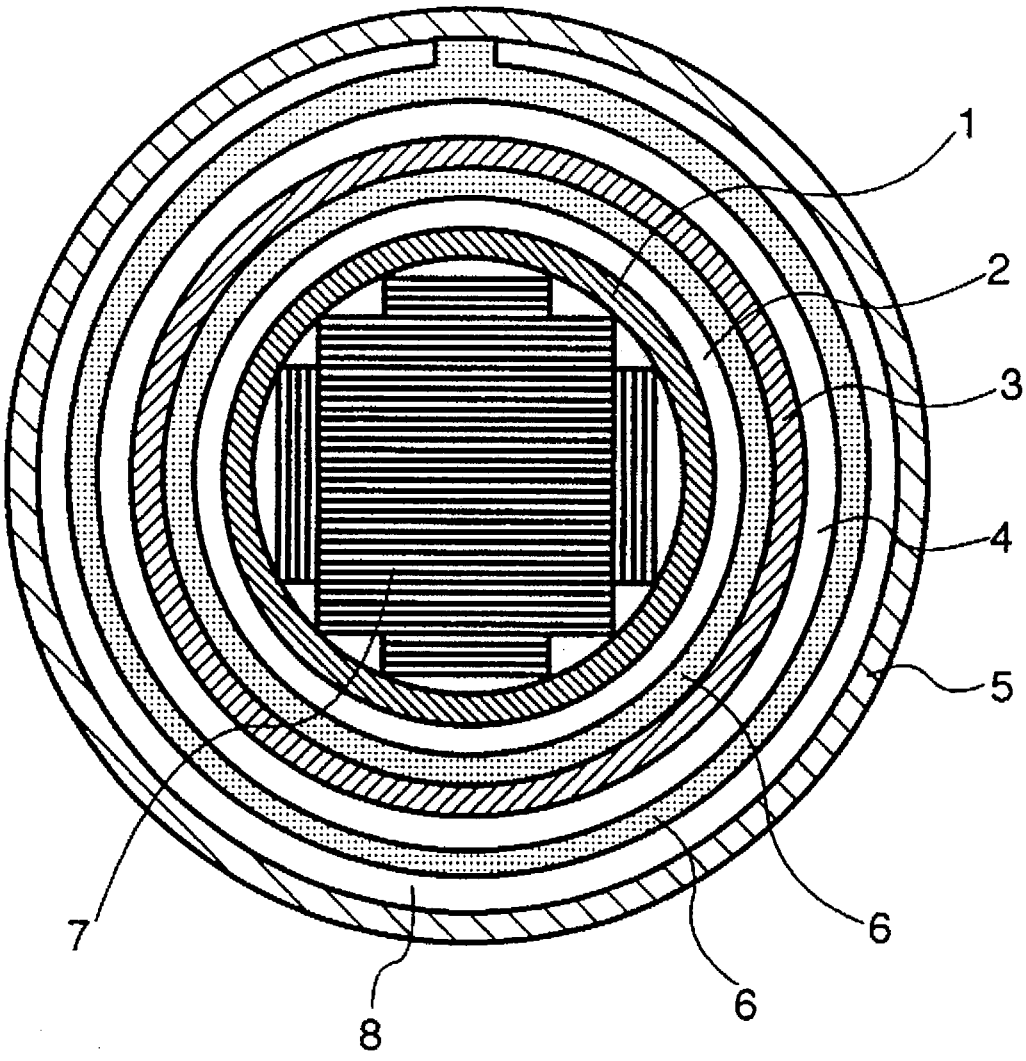
FIG. 2 is a cross section view of the ignition apparatus taken along the line II—II, in which a side core is disposed inside a housing.

FIG. 1 is a sectional view showing an ignition apparatus in which cores that form a closed magnetic circuit are used, and FIG. 2 is a cross section view of the ignition apparatus taken along the line II—II, in which a side core is disposed inside a housing.

Figure 3:
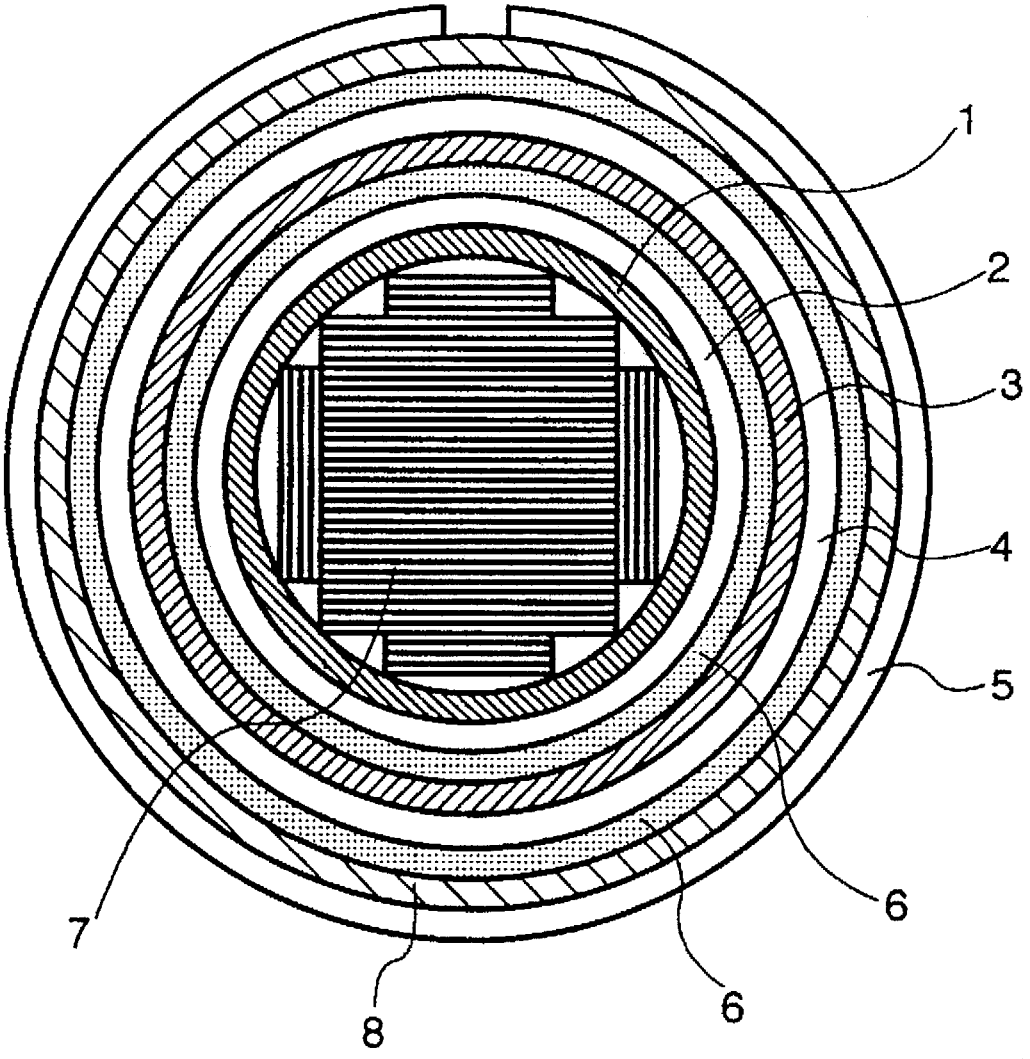
FIG. 3 is a cross section view of the ignition apparatus, in which the side core is disposed outside the housing.

A primary coil 2 is wounded around a primary bobbin 1 formed by molding thermoplastic synthetic resin or thermosetting synthetic resin. A secondary coil 4 is wounded around a secondary bobbin 3 formed by molding the same synthetic resin as the primary bobbin. The primary coil 2 comprises several layers of enamel windings, each formed by the enamel wires with the diameter of 0.3 mm to 1.0 mm. Therefore, the primary coil 2 is formed by the laminated enamel windings, and the total number of turns of the enamel windings is within the range of 100 to 300. The secondary coil 4 is formed by winding enamel wires with the diameter of 0.03 mm to 0.1 mm. The secondary coil 4 is provided with a plurality of sets of enamel windings, and the total number of turns is within the range of 5,000 to 20,000. A housing 5 is made of the same resin as the primary bobbin 1. In case that high precision for parts such as a cylindrical type ignition apparatus is required, it is effective to use polyphenylene sulfide as the primary bobbin 1 and/or the housing 5. A center core 7 is made of the pressed and laminated silicone steel plates and disposed inside the primary bobbin 1. A side core 8 is made of cylinderical and thin silicone steel plates, and disposed outside the secondary coil 4 and inside the housing 5. By using thin rolled silicone steel plates as a side core and forming it in a cylidrical shape as described above, it becomes possible to enlarge the cross-sectional area as compared with the simply laminated silicone steel plates (in case that rolled silicone steel plates are simply stacked or laminated to form a side core, the width of the side core may become larger). The side core 8 may be disposed outside the secondary coil 4 and outside the housing 5 as shown in FIG. 3. However, in any cases, it is required to cut away at least one portion of the perimeter of a circle of the side core in order to prevent one turn short-circuit of magnetic flux. To form a closed magnetic path by connecting magnetically the center core 7 and the side core 8, a low voltage core 9 is disposed on a low voltage side of the secondary coil 4, and a high voltage core 10 is disposed on a high voltage side of the secondary coil 4.

A core gap 11 is provided in a portion of the cores comprised of the center core 7, the side core 8, the low voltage core 9 and the high voltage core 10, which form the closed magnetic path. Because a magnet 12 acts to generate the reversely directed magnetic flux in a magnetic path, the cores formed by the silicone steel plates can operate in a point lower than the saturation point of a magnetization curve for the cores.

Figure 10:
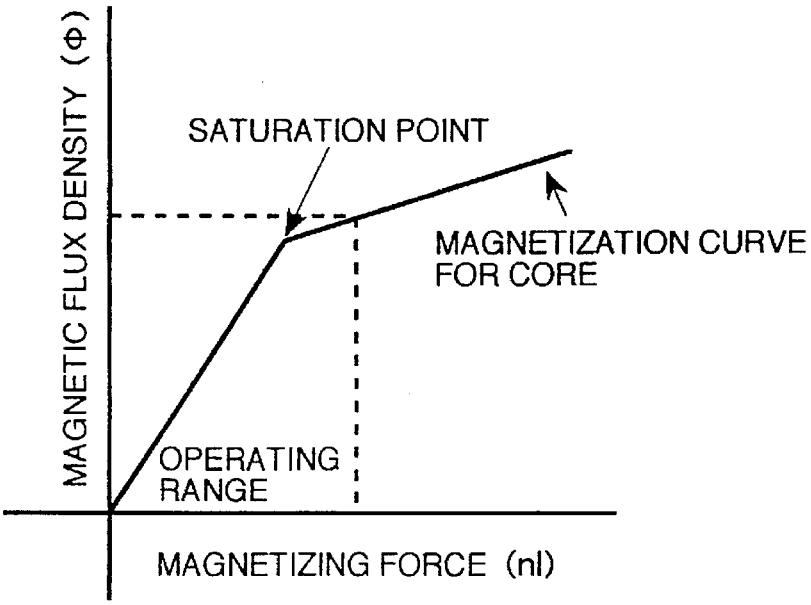
FIG. 10 is a view showing a magnetization curve for cores in which a magnet is not provided.
Figure 11:
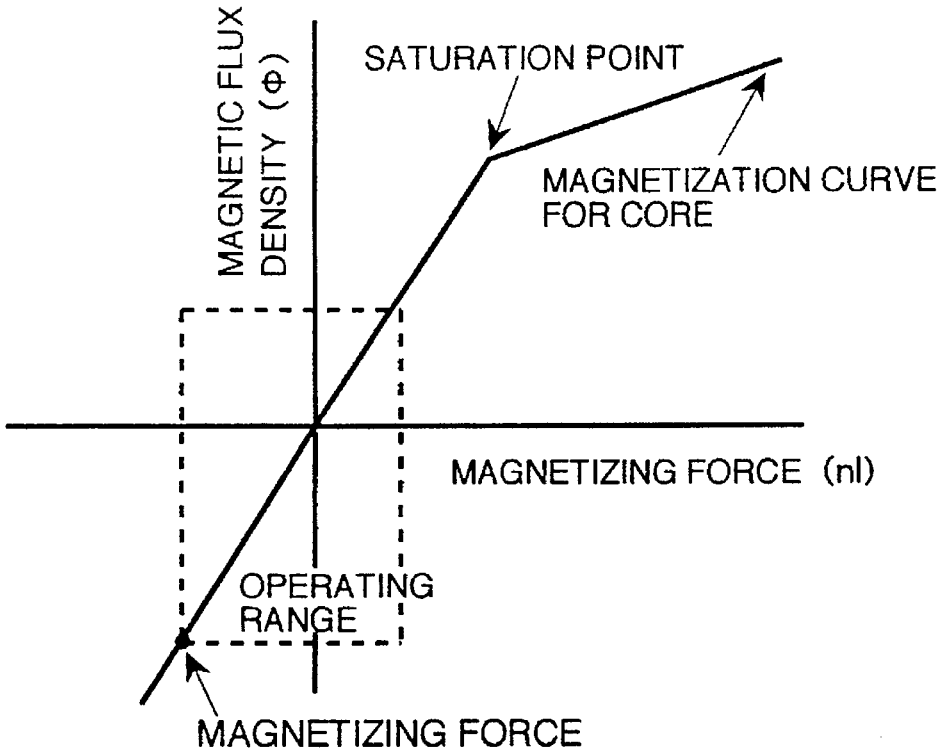
FIG. 11 is a view showing a magnetization curve for cores in which a magnet is provided.

Referring now to FIGS. 10 and 11, FIG. 10 shows a magnetization curve for cores in which a magnet is not provided, and FIG. 11 shows a magnetization curve for a core in which a magnet is provided.

As shown in FIG. 10, the operating range of the magnetizing force when the magnet is not provided includes the saturation point. However, the operating range of the magnetizing force when the magnet is provided does not include the saturation point, that is, it does not reach the saturation point. Accordingly, it is possible to lessen the loss of energizing due to the saturation of cores, and to suppress the generation of heat due to the energizing. For example, if the magnet is used, of which coercive force at ordinary temperatures is larger than 5 kOe, it becomes possible to lessen the demagnetization due to heat, and maintain sufficient coercive force even at 140° C. to 150° C. at which the apparatus is used. Further, it is also possible to suppress the variation of the coercive force with respect to that of temperatures. Because such the magnet with strong coercive force is heat-resistant, it is possible integrally to mold with the resin-made bobbin.

A coil portion comprising the primary and secondary coils, and the center core is inserted into the housing 5. Therefore, a high voltage can be insulated by the insulating layer 6 made of insulation oil or epoxy resin. It is preferable to use the epoxy resin that the glass transition point Tg after setting falls within the range of 115° C. to 135° C., and the average value of the coefficient of thermal expansion in the temperature range lower than the glass transition point Tg exists at 10~50×10E−6.

A current is supplied to the primary coil 2 through an igniter unit 20 and a connector 32 provided in the upper portion of the ignition apparatus. A high voltage generated by the secondary coil 4 is supplied to a spark plug (not shown) through a high voltage terminal 13 and a spring 14. The portion where the spark plug is inserted into is insulated by using a rubber boot 15 such as a silicone rubber.

Figure 4A:
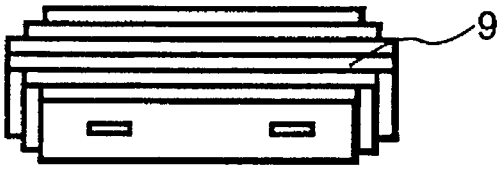
FIG. 4A is a perspective view of a polygonal core disposed on a low voltage side.
Figure 4B:
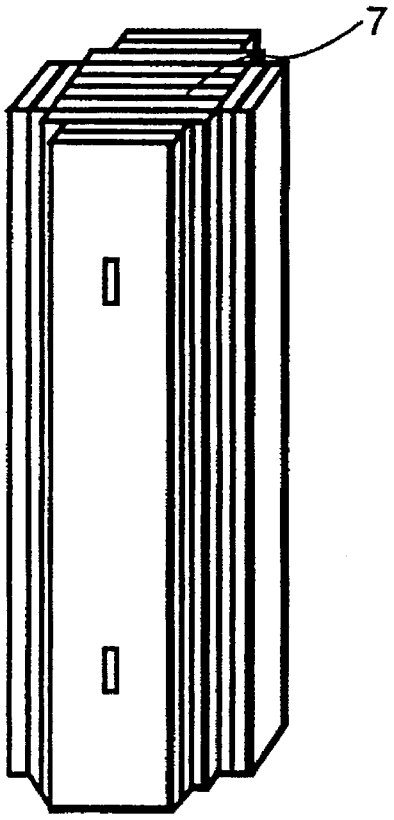
FIG. 4B is a perspective view of a polygonal center core.

In the above-described embodiment, the center core is polygonal and formed by combining blocks as shown in FIG. 4. Each of the blocks is formed by stacking or laminating a plurality of rolled silicone steel plates with different width. Therefore, without upsizing the ignition apparatus as a whole, it becomes possible to enlarge the sectional area of the center core. It is possible to form such the silicone steel plates with different width by pressing (punching) band silicone steel plates with changing the width of press. The block can be formed by press-stacking the silicone steel plates with the same width and then caulking it. A plurality of blocks are combined with one another and then caulked to form a polygonal core. In the example shown in FIG. 4, the block with the width different from a square block is combined with four sides of the square block as clearly seen from FIGS. 2 and 3. Further, the lamination direction of the rolled silicone steel plates forming the blocks disposed on the left and right is different from that of the rolled silicone steel plates forming the square block on the drawings.

Figure 5:
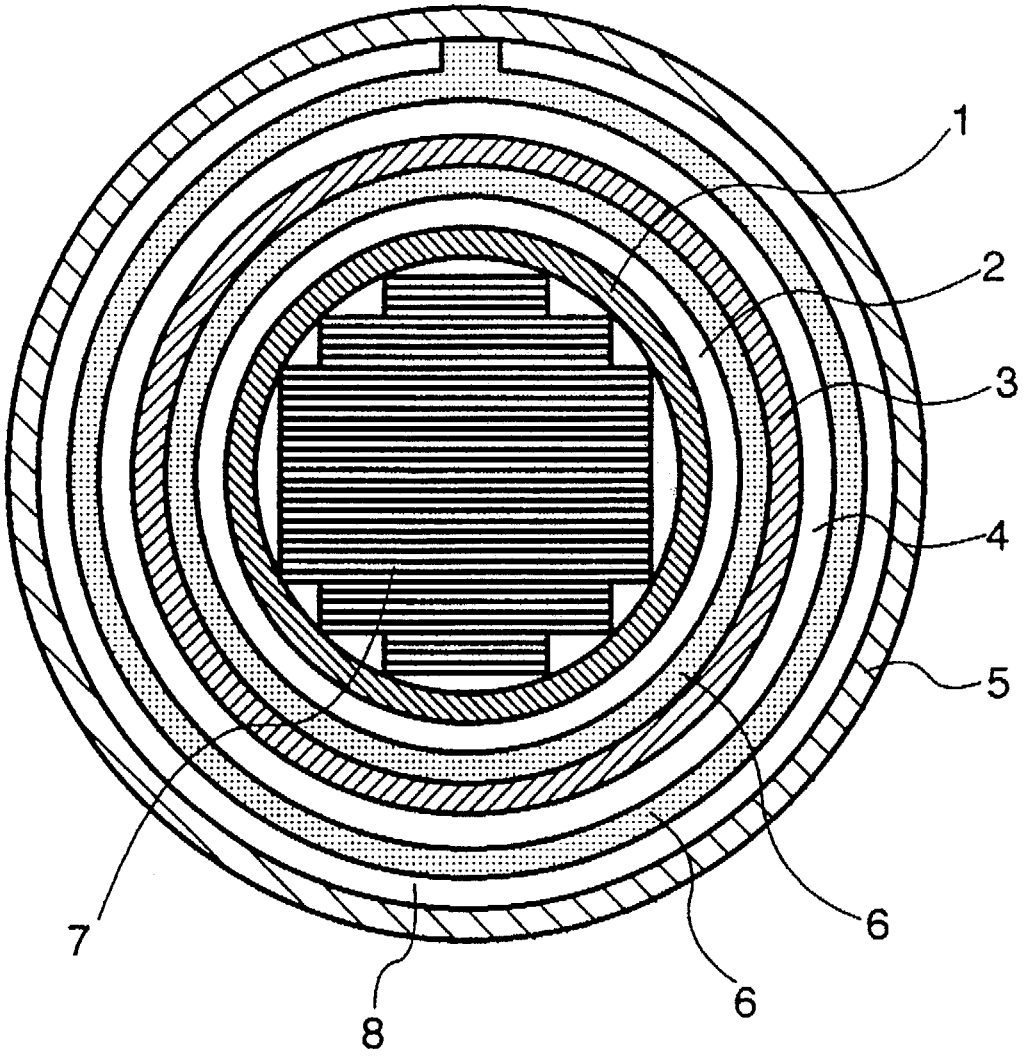
FIG. 5 is a cross section view of the ignition apparatus in which the center core is formed by stacking a plurality of rolled silicon steel plate in the same direction.

FIG. 5 shows the ignition apparatus in which the center core is formed by stacking a plurality of rolled silicon steel plates in the same direction. As shown in FIG. 5, by allowing more than three kinds of laminated blocks with different width to combine in the same lamination direction, it becomes very easy to caulk the combined blocks.

Figure 6A:
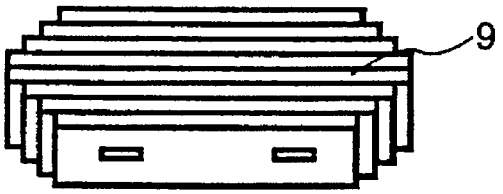
FIG. 6A is a perspective view of a cylindrical core disposed on a low voltage side.
Figure 6B:
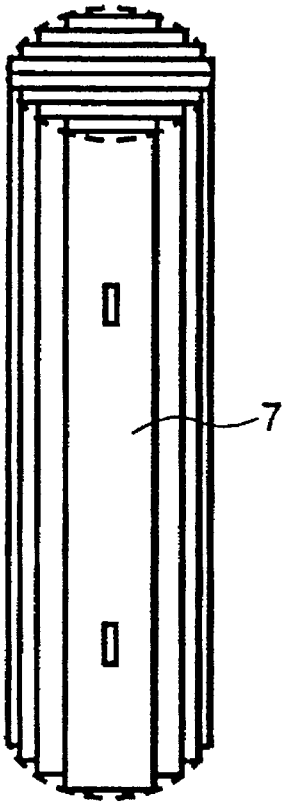
FIG. 6B is a perspective view of a cylindrical center core.
Figure 7:
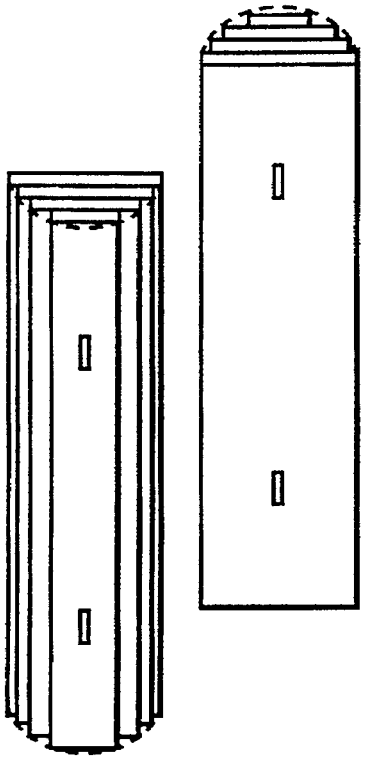
FIG. 7 is a perspective view illustrating a method of fabricating the cylindrical center core.

It should be appreciated that the center core can be formed in a rectangular shape without combining a plurality of laminated blocks. Further, as shown in FIG. 6, the center core may be formed by stacking silicone steel plates of which width are increased or decreased gradually so that the shape of said center core can become almost cylindrical. In order to increase the sectional area of the center core and thus the output power, it is effective to form it as cylindrical as possible. Such a cylindrical center core can be formed as shown in FIG. 7. After laminating and caulking a plurality of silicone steel plates with different width to make a semi-cylinder, two semi-cylinders is caulked to make a cylinder. It is, further, possible to form the rectangular center core by laminating and caulking a plurality of silicone steel plates of the same shape.

Figure 8:
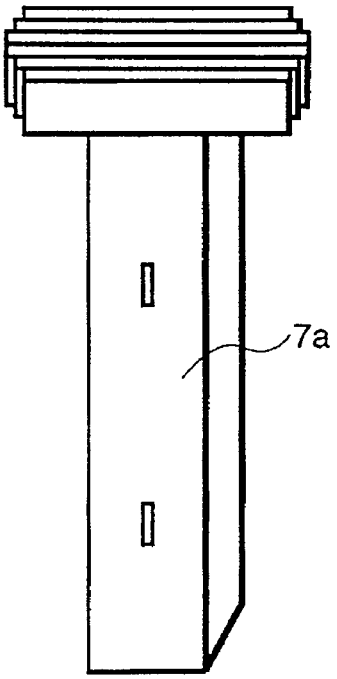
FIG. 8 is a perspective view of an integrated core in which the polygonal center core is combined with the core disposed on a low voltage side.
Figure 9:
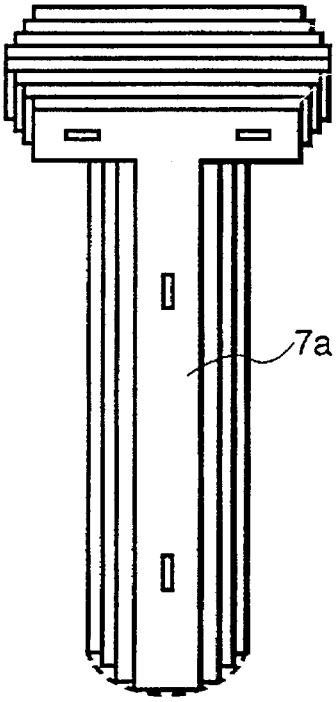
FIG. 9 is a perspective view of an integrated core in which the cylindrical center core is combined with the core disposed on a low voltage side.

While the center core 7 and the core on a low voltage side are fabricated independently in the embodiments shown in FIGS. 4 and 6, it is possible integrally to form them as the center core of a T-shape as shown in FIGS. 8 and 9. The T-shape center core also can be fabricated in the same way as the above-described center core 7.

There is provided at the upper portion of the coil part the igniter unit 20 to control ON/OFF of the energization of the coil. As seen from FIG. 12, a heatsink 29 is mounted at the top of an igniter unit 20. A metal plate 30 for heat radiation and a transistor chip 21 are mounted on and under the heatsink 29, respectively. The metal plate 30 is bonded to the heatsink 29 by using adhesive 31 and embeded into the epoxy resin. Where, the thickness A of the metal plate 30 is 1 mm to 3 mm, and the thickness B of the insulating layer 6 is less than 3 mm. As a result, the heat generated from the power transistor chip 21 is radiated through the insulating layer 6 to the atomosphere. The heatsink 29 can be made of copper, brass or alminium, the metal plate 30 copper or alminium, and silicone adhesive can be used as the adhesive.

Figure 12:
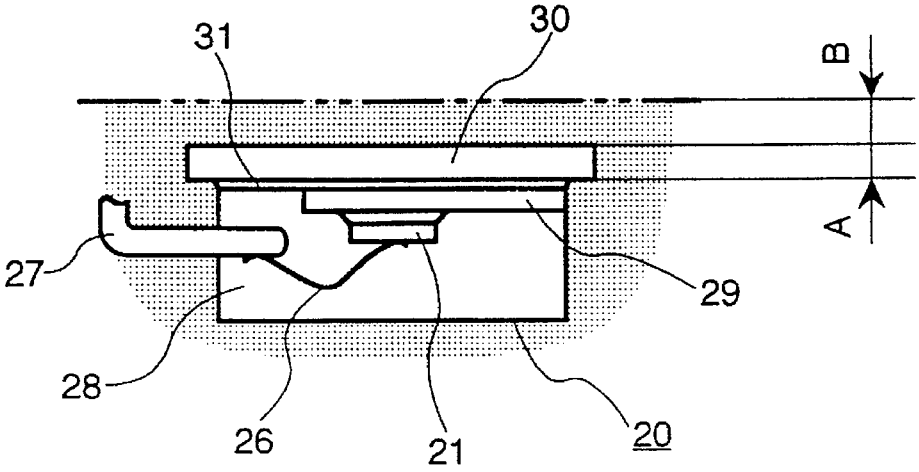
FIG. 12 is a section view showing the configuration of an igniter unit.
Figure 13:
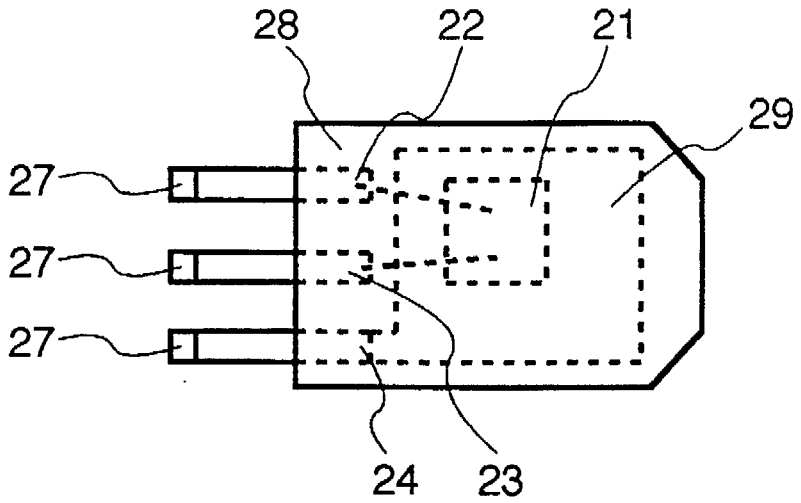
FIG. 13 is an external view of the igniter unit.
Figure 14:
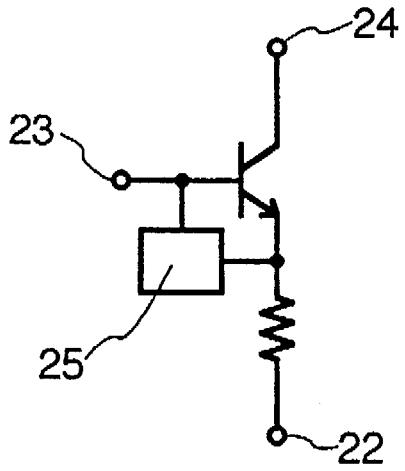
FIG. 14 is a circuit diagram of these igniter unit.

As shown in FIG. 13, the heatsink 29 has the same configuration as a collector 24 of the power transistor, or is connected to it. A terminal 27 is provided at the edge portion of the collector 24. The terminal 27 can be made of copper, brass or alminium. As shown in FIG. 12, an emitter 22 and a base 23 of the power transistor is connected through an alminium-made wire 26 to the terminal 27. The power transister 21, etc. is molded by a transfer mold 28 made of epoxy resin. The igniter unit 20 incorporates a current limit circuit 25 as shown in FIG. 14.

Figure 15:
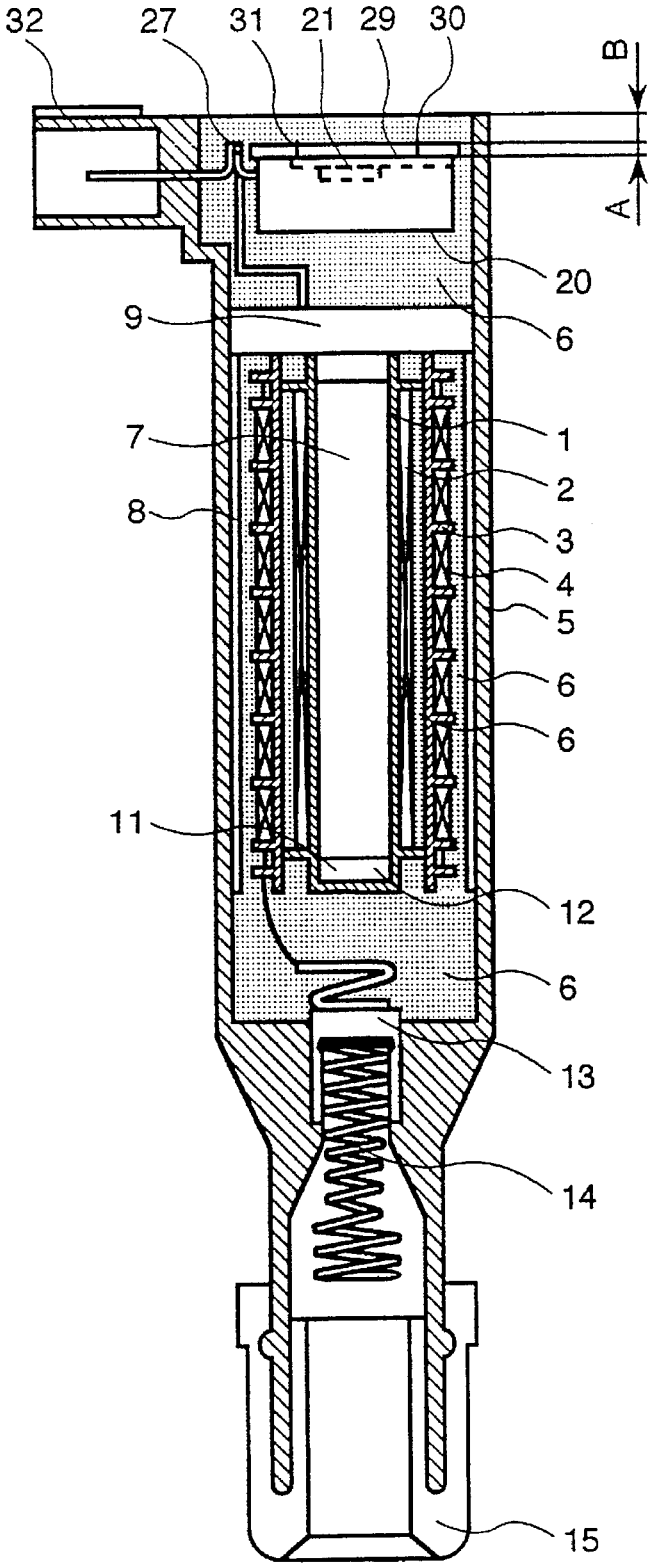
FIG. 15 is a section view of the ignition apparatus in which cores that form a semi-closed magnetic path are used.

In the embodiment shown in FIG. 1, a closed magnetic path is formed by connecting magnetically the center core 7 and the side core 8 by a core on a high voltage side and a core on a low voltage side. However, in the embodiment shown in FIG. 15, a semi-closed magnetic path is formed by connecting magnetically the center core and the side core only by using a core on a low voltage side. Thereby, in either case, the leakage of the magnetic flux can be lessen. With respect to the improvement of output power, the closed magnetic path is better than the semi-closed magnetic path. Because a core is provided on a low voltage side of the secondary coil to make a semi-closed magnetic path, it is easy to insulate between the core and the secondary coil, as compared with the configuration in which the core is provided on a high voltage side of the secondary coil. As to the semi-closed magnetic path, it is effective to provide a magnet or magnets on a single side or both sides of the center core 7 in order to increase the output power.

While in the embodiment described above, the center core 7, the primary coil 2, secondary coil 4, and side core 8 are arranged in order from the center core, the primary coil may be interchanged with the secondary coil.

What is claimed is:

1. A cylindrical type ignition apparatus housed in a plug hole and connected directly to a spark plug, comprising a center core, a primary coil and a secondary each disposed outside the center core, a side core disposed outside those coils, and a core disposed on a lower voltage side, for connecting magnetically said center core and said side core.

2. A cylindrical type ignition apparatus according to claim 1, further comprising a core disposed on a higher voltage side, for connecting magnetically said center core and said side core.

3. A cylindrical type ignition apparatus according to claim 1, wherein said side core is made of cylindrical rolled silicon steel plates with a vertically cut-away portion.

4. A cylindrical type ignition apparatus according to claim 1, wherein said center core is polygonal and formed by combining blocks, each of the blocks being formed by stacking a plurality of rolled silicone steel plates with different width.

5. A cylindrical type ignition apparatus according to claim 1, wherein said center core is formed by stacking silicone steel plates of which width are increased or decreased gradually to allow the shape of said center core to become almost cylindrical.

6. A cylindrical type ignition apparatus according to claim 1, wherein said center core is formed by stacking rolled silicone steel plates and its cross-section is almost quadrangular.

7. A cylindrical type ignition apparatus according to claim 1, wherein said core for connecting magnetically said center core and said side core is formed by combining said center cores into a T-shape.

8. A cylindrical type ignition apparatus according to claim 1, wherein there is provided at an air-gap portion a magnet for biasing reversely against the magnetic flux generated by the primary coil.

9. A cylindrical type ignition apparatus according to claim 8, wherein coercive force of the magnet is larger than 5 kOe.

10. A cylindrical type ignition apparatus according to claim 1, wherein thermoplastic synthetic resin such as epoxy resin is used to insulate a high voltage generated by said secondary coil.

11. A cylindrical type ignition apparatus according to claim 1, wherein said thermoplastic systhetic resin is epoxy resin in which a glass transition point after setting falls within the range from 115° C. to 145° C., and wherein the average coefficient of thermal expansion in the range of temperatures lower than the glass transition point is 10~50× 10E–6.

12. A cylindrical type ignition apparatus according to claim 1, wherein insulating oil is used to insulate a high voltage generated by said secondary coil.

13. A cylindrical type ignition apparatus according to claim 1, wherein an igniter unit is provided in the upper portion of a coil of said ignition apparatus.

14. A cylindrical type ignition apparatus according to claim 13, wherein said igniter unit is resin-molded.

15. A cylindrical type ignition apparatus according to claim 14, wherein said igniter unit includes a power transistor chip, wherein a metallic plate for heat radiation is bonded to a heatsink side of the power transistor chip and the metallic plate is made of copper or alminium of which width is from 0.5 mm to 3 mm, and wherein the thickness of the resin mold is less than 3 mm.

* * * * *

UNITED STATES PATENT AND TRADEMARK OFFICE

CERTIFICATE OF CORRECTION

PATENT NO. : 5,632,259

DATED : May 27, 1997

INVENTOR(S) : Kondo Et Al.

It is certified that error appears in the above-identified patent and that said Letters Patent is hereby corrected as shown below:

On title page, item [19] change "KONDA" to --KONDO--

Item [75]

Change the first inventor's last name from "KONDA" to -- KONDO --.

Signed and Sealed this

Twenty-fourth Day of February, 1998

*Attest:*

Bruce Lehman

BRUCE LEHMAN

*Attesting Officer*

*Commissioner of Patents and Trademarks*